US008769903B2

(12) United States Patent
Svec

(10) Patent No.: US 8,769,903 B2
(45) Date of Patent: Jul. 8, 2014

(54) TPO BATTEN SYSTEM

(71) Applicant: Building Materials Investment Corporation, Wilmington, DE (US)

(72) Inventor: James A. Svec, Wayne, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 0 days.

(21) Appl. No.: 13/684,468

(22) Filed: Nov. 23, 2012

(65) Prior Publication Data

US 2013/0125488 A1 May 23, 2013

Related U.S. Application Data

(60) Provisional application No. 61/563,328, filed on Nov. 23, 2011.

(51) Int. Cl.
*E04D 1/34* (2006.01)

(52) U.S. Cl.
CPC ..... *E04D 1/34* (2013.01)
USPC ..... 52/551; 52/745.19

(58) Field of Classification Search
USPC ..... 52/309.1, 309.2, 309.16, 520, 521, 543, 52/544, 546, 551, 553, 285.1, 285.3, 52/309.11, 489.1, 489.2, 552, 745.19
See application file for complete search history.

(56) References Cited

U.S. PATENT DOCUMENTS

| | | | | |
|---|---|---|---|---|
| 4,718,211 | A * | 1/1988 | Russell et al. | 52/409 |
| 6,206,991 | B1 | 3/2001 | Hick | |
| 7,454,873 | B2 * | 11/2008 | McClintick | 52/551 |
| 7,666,491 | B2 | 2/2010 | Yang | |
| 2004/0148898 | A1 | 8/2004 | Hick | |
| 2006/0266000 | A1 * | 11/2006 | Morris et al. | 52/783.11 |
| 2009/0272062 | A1 * | 11/2009 | Gibbs | 52/543 |
| 2010/0095618 | A1 | 4/2010 | Edison | |
| 2011/0016811 | A1 * | 1/2011 | Kalkanoglu et al. | 52/309.1 |
| 2011/0225904 | A1 | 9/2011 | Railkar | |

FOREIGN PATENT DOCUMENTS

JP 08-246607 A1 9/1996

OTHER PUBLICATIONS

International search report and written opinion of international searching authority in PCT/US2012/066469 dated Feb. 15, 2013.

* cited by examiner

*Primary Examiner* — William Gilbert
*Assistant Examiner* — Kyle Walraed-Sullivan
(74) *Attorney, Agent, or Firm* — Baker & McKenzie LLP

(57) ABSTRACT

Disclosed herein are various embodiments of a batten system comprising thermoplastic polyolefin (TPO) membranes. In an embodiment, a batten may comprise a plurality of TPO membranes heat sealed together. The heat sealed TPO membranes may include a plurality of unsealed areas between the membranes for engaging one or more coupling devices. Slate shingles may be hung from the one or more coupling devices.

20 Claims, 7 Drawing Sheets

TPO BATTEN SYSTEM

RELATED APPLICATIONS

This application claims priority to U.S. Provisional Application No. 61/563,328 filed Nov. 23, 2011, the entire contents of which are hereby incorporated in their entirety by this reference.

TECHNICAL FIELD

The present disclosure generally relates to roofing battens, and more particularly, to a thermoplastic polyolefin (TPO) based roofing batten system comprising two TPO membranes configured to receive one or more coupling devices therebetween.

BACKGROUND

Slate is one of the finest roofing materials available and has several advantages over asphalt shingle roofs. Slate roofing is fireproof, resists hail damage, and often has a service life of 100 years or more. However, slate is a rigid natural stone product which unfortunately can be damaged by stress. Stress can be introduced into slate in several ways, but the most common cause of stress to slate is nails used to attach the slate to the roof deck. With nail installation, the nails need to be fastened so the slate hangs on the nail. If the nail is inserted too tightly, the nail will pinch the slate. On the other hand, if the nail is not inserted deep enough, the overlapping piece of slate may crack from the hidden pressure point. Environmental effects on the wood decking and nails may also contribute to the stress. Environmental changes such as swings in temperature and humidity can cause the decking to expand and contract. If the nails are in a bind in this situation, the slate can crack or fall.

SUMMARY

Disclosed herein are various embodiments of a batten system comprising thermoplastic polyolefin (TPO) membranes. In an embodiment, a batten may comprise a plurality of TPO membranes heat sealed together. The heat sealed TPO membranes may include a plurality of unsealed areas between the membranes for engaging one or more coupling devices. Slate shingles may be hung from the one or more coupling devices.

The present disclosure relates, in some embodiments to a roofing batten system comprising a first TPO membrane comprising a first TPO scrim layer disposed between a first TPO upper layer and a first TPO lower layer and a second TPO membrane comprising a second TPO scrim layer disposed between a second TPO upper layer and a second TPO lower layer, wherein the first TPO lower layer is heat sealed with the second TPO upper layer at sealed areas while leaving a plurality of unsealed areas between the first TPO membrane and the second TPO membrane at intervals and wherein one or more coupling devices may be received through adjacent unsealed areas between the first TPO membrane and the second TPO membrane such that each coupling device may be fastened to the roofing batten system by mating at a top edge of a sealed area and hooking at a bottom edge of the sealed area.

According to some embodiments, a roofing batten system may comprise a first TPO membrane comprising a first TPO upper layer, a first TPO lower layer, and, optionally, a first TPO scrim layer disposed therebetween and a second TPO membrane comprising a second TPO upper layer, a second TPO lower layer, and, optionally, a second TPO scrim layer disposed therebetween, wherein the first TPO lower layer is heat sealed with the second TPO upper layer at sealed areas while leaving a plurality of unsealed areas between the first TPO membrane and the second TPO membrane at intervals and wherein adjacent unsealed areas between the first TPO membrane and the second TPO membrane are configured to receive a coupling device such that the coupling device contacts the top edge of the interposing sealed area and secures at the bottom edge of the interposing sealed area. A received coupling tool may comprise, for example, a first portion receivable in the first unsealed area, a second portion contactable with the upper edge, a third portion receivable in the second unsealed area, and a fourth portion securable to the bottom edge. A coupling tool (e.g., a fourth portion) may comprise a hook, a tail, a latch, a shoulder or combinations thereof. A coupling tool may comprise a fifth portion comprising, for example, an extension configured to contact (e.g., secure) a shingle. In some embodiments, a coupling tool may have any suitable geometric shape including, for example, a generally rectangular shape with one open side or a generally hexagonal shape with one open side.

Two or more unsealed areas, according to some embodiments, may be substantially parallel to each other. A first unsealed area, a second unsealed area, or both a first unsealed area and a second unsealed area may be substantially parallel to a fall line according to some embodiments.

The present disclosure relates, in some embodiments, to a roofing batten system, which may comprise a first TPO membrane comprising a first TPO upper layer, a first TPO lower layer, and, optionally, a first TPO scrim layer disposed therebetween; a second TPO membrane comprising a second TPO upper layer, a second TPO lower layer, and, optionally, a second TPO scrim layer disposed therebetween. A roofing batten system may comprise a first sealed area comprising a heat seal between a first portion of the first TPO lower layer and a first portion of the second TPO upper layer, a second sealed area comprising a heat seal between a second portion of the first TPO lower layer and a second portion of the second TPO upper layer, and a third sealed area comprising a heat seal between a third portion of the first TPO lower layer and a third portion of the second TPO upper layer, wherein the first sealed area and the second sealed area are separated by a first unsealed area, wherein the second sealed area and the third sealed area are separated by a second unsealed area, and wherein the first unsealed area and the second unsealed area are configured to receive a coupling device between the first TPO membrane and the second TPO membrane. In some embodiments, a first TPO membrane and a second TPO membrane may together define an upper edge and lower edge (e.g., of a TPO batten system). An unsealed area may include an opening along the top edge and an opening along the lower edge in some embodiments. A first unsealed area may be configured to permit a coupling tool to contact the top edge and/or a second unsealed area may be configured to permit the coupling tool to be secured at the bottom edge. According to some embodiments, a received coupling tool may comprise a first portion receivable in a first unsealed area, a second portion contactable with an upper edge, a third portion receivable in a second unsealed area, and a fourth portion securable to a bottom edge. A coupling tool (e.g., a fourth portion) may comprise a hook, a tail, a latch, a shoulder or combinations thereof. A coupling tool may comprise a fifth portion comprising, for example, an extension configured to contact (e.g., secure) a shingle. In some embodiments, a coupling tool may have any suitable geometric shape including, for example, a generally rectangular shape with one open side or a generally hexagonal shape with one open side. In some embodiments, the first TPO membrane comprises a first TPO scrim layer and the second TPO membrane comprises a second TPO scrim layer.

According to some embodiments, the present disclosure relates to methods for securing a shingle to a roof and/or a roof substrate with a roofing batten system. A roofing batten system for use in a method may comprise, for example, (a) a first TPO membrane comprising a first TPO upper layer, a first TPO lower layer, and, optionally, a first TPO scrim layer disposed therebetween, (b) a second TPO membrane comprising a second TPO upper layer, a second TPO lower layer, and, optionally, a second TPO scrim layer disposed therebetween, (c) a first sealed area comprising a heat seal between a first portion of the first TPO lower layer and a first portion of the second TPO upper layer, (d) a second sealed area comprising a heat seal between a second portion of the first TPO lower layer and a second portion of the second TPO upper layer, and (e) a third sealed area comprising a heat seal between a third portion of the first TPO lower layer and a third portion of the second TPO upper layer, wherein the first sealed area and the second sealed area are separated by a first unsealed area, and wherein the second sealed area and the third sealed area are separated by a second unsealed area, wherein the first unsealed area and the second unsealed area are configured to receive a coupling device between the first TPO membrane and the second TPO membrane. A method may include, for example, fixing the second TPO lower layer to a roof substrate, inserting a coupling tool comprising a first portion, a second portion, a third portion, and a fourth portion into the first unsealed area and the second unsealed area such that the first portion is received in the first unsealed area, the second portion contacts the upper edge of the second sealed area, the third area is received in the second unsealed area, and the fourth portion secures the coupling tool; and hanging a shingle from the coupling tool. In some embodiments, a method may include securing a slate shingle to a roof and/or roof substrate. Fixing the second TPO lower layer to the roof substrate may comprise mechanically fastening the second TPO lower layer to the roof substrate and/or coating the deck side of the second TPO lower layer with an adhesive and laminating the roofing batten system to the roof.

DETAILED DESCRIPTION

An objective of one aspect of the present disclosure is to provide an inexpensive slate roof installation system. One approach of slate roof installation allows a plurality of coupling devices to be installed with a batten system constructed from metals such as stainless steel, as disclosed in U.S. Pat. No. 7,454,873, which is commonly-owned and incorporated by reference herein. While metallic battens may be suitable in some applications of slate roof installation, cost savings may be realized if a less expensive material may be used to construct a batten system that satisfies the performance goals of roof installation.

Disclosed herein are various embodiments of a batten system comprising TPO membranes. TPO based roofing membranes are one of many types of roofing membranes available on the market today. TPO may be a melt blend or reactor blend of a polyolefin plastic, such as a polypropylene polymer, with an olefin copolymer elastomer (OCE), such as an ethylene-3Q propylene rubber (EPR) or an ethylene-propylene-diene rubber (EPDR). Examples of commercially available TPO membranes include SURE WELD™ (Carlisle Inc.), GENFLEX™ (Omnova Solutions, Inc), ULTRAPLY™ (Firestone Building Products) and EVERGUARD TPO™ (OAF). Stretchable TPO membranes are disclosed in U.S. Pat. No. 7,666,491, which is also commonly-owned and incorporated by reference herein.

Figure 1:
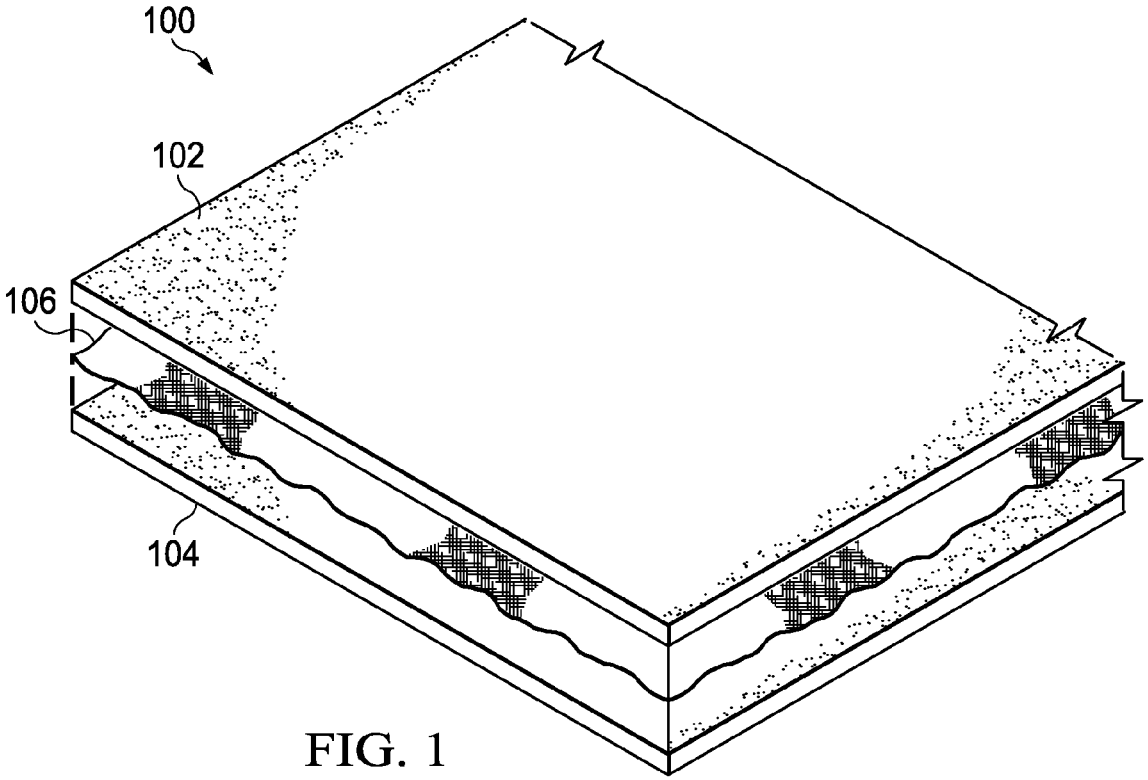
FIG. 1 is a partial, exploded perspective view of a TPO membrane, in accordance with the present disclosure.

FIG. 1 is a partial, exploded perspective view of a TPO membrane 100. The membrane 100 comprises a cap layer 102 and a core layer 104. In an embodiment, the membrane 100 may further include an optional scrim layer 106 substantially sandwiched between the cap layer 102 and the core layer 104. The scrim is generally the strongest layer in the composite TPO membrane 100 and may be a woven, nonwoven, or knitted fabric composed of continuous strands of material used for reinforcing or strengthening membranes. The fabric can contribute significantly to the tensile strength of the roofing membrane and provide for dimensional stability. In an example, the fabric reinforcement comprises a polyester yarn based scrim. Glass fiber based scrims may also be used for situations where additional weight and/or improved dimensional stability are desired. Each of the cap layer 102 and core layer 104 may be made of a material, such as TPO.

Figure 2A:
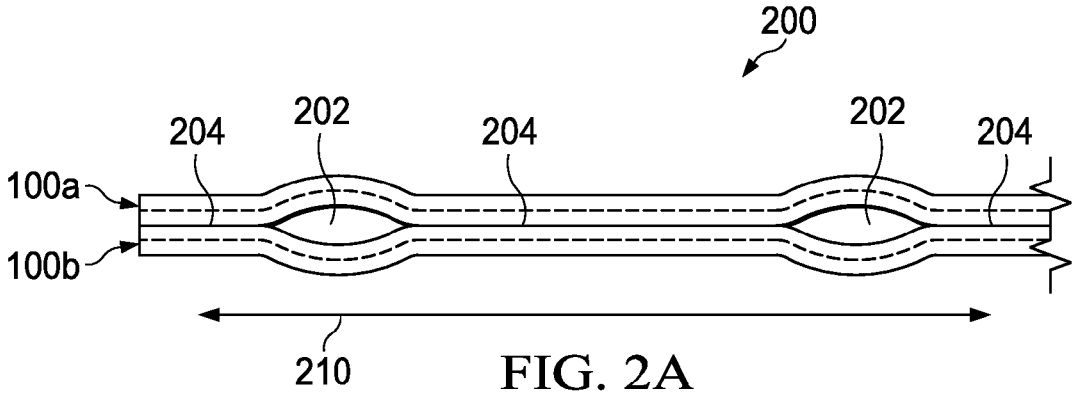
FIG. 2A is a partial, cross sectional view of a TPO batten system, in accordance with the present disclosure.
Figure 2B:
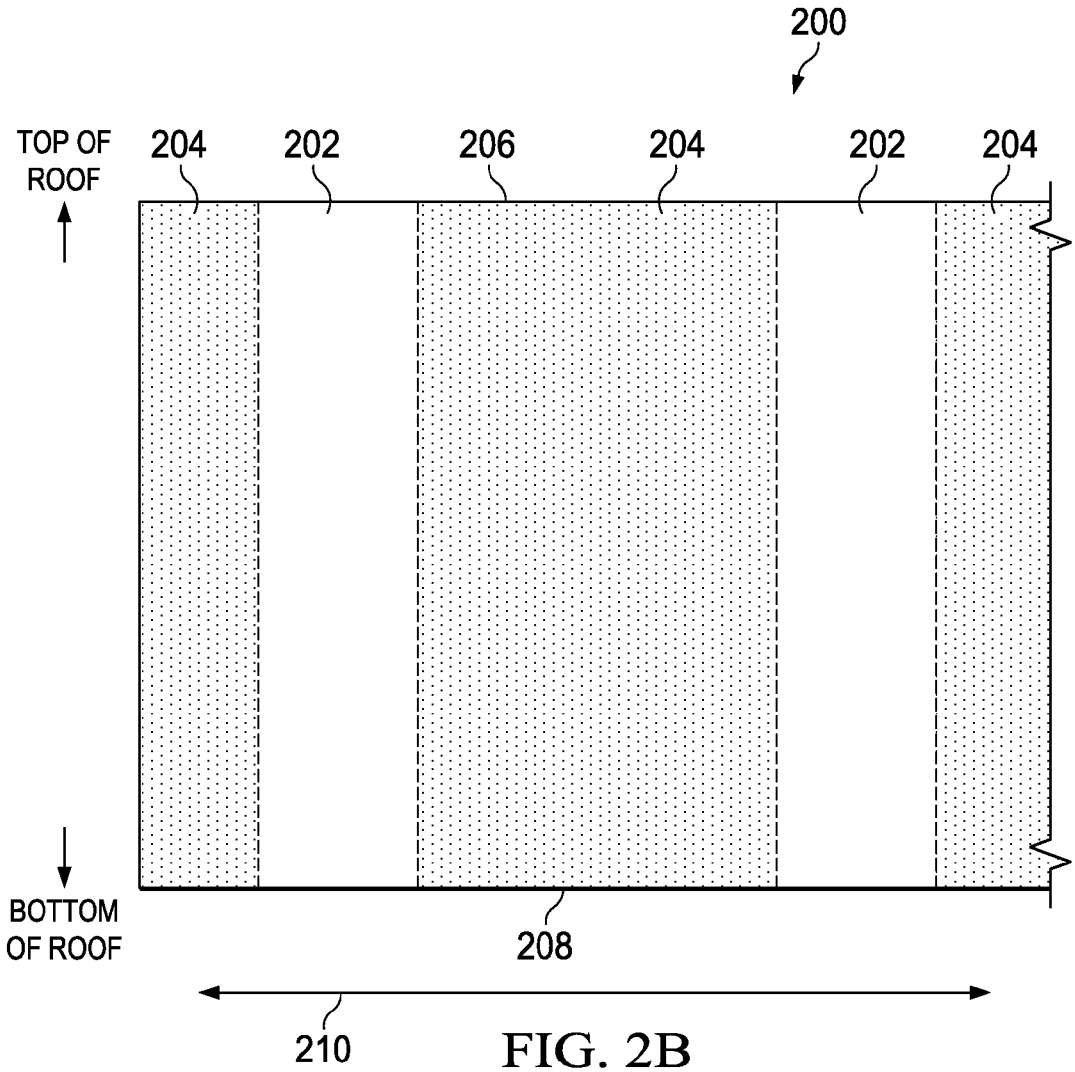
FIG. 2B is a partial, top view of the TPO batten system of FIG. 2A, in accordance with the present disclosure.

FIG. 2A is a partial, cross sectional view of a TPO batten system 200. FIG. 2B is a top view of the TPO batten system 200. The TPO batten system 200 may include TPO membranes 100*a*, 100*b*, which may be any TPO membrane known in the art. In an embodiment, the TPO membranes 100*a*, 100*b* may be similar to the TPO membrane 100 discussed above. In an embodiment the TPO membranes 100*a*, 100*b* may be heat sealed together at sealed areas 204 while leaving unsealed areas 202 at desired intervals along a longitudinal direction 210. The two TPO membranes 100*a*, 100*b* may be bonded together using an adhesive rather than heat sealed in an embodiment. The two TPO membranes 100*a*, 100*b* may also be mechanically fastened together using staples or a similar fastening device.

The sealed areas 204 and the unsealed areas 202 may be located between a bottom layer of the TPO membrane 100*a* and an upper layer of the TPO membrane 100*b*. The unsealed areas 202 are shown as open areas in FIG. 2A for clarity, but it is to be appreciated that the TPO membranes 100*a*, 100*b* may normally lie substantially flat against each other in both the sealed areas 204 and the unsealed areas 202. The unsealed areas 202 may each define an opening extending from a first edge 206 to a second edge 208 while being bound by sealed areas 204 in the longitudinal direction 210.

The unsealed areas 202 may be configured to allow a suitable coupling device (not shown) to pass through and be seated in the batten system 200. As shown in FIG. 2B, in an embodiment, the openings created by the one or more unsealed areas 202 may be configured to run parallel to the fall line created by the roof, i.e., the line on the roof which water would flow if poured from the top of the roof down the slope of the roof.

When installed on the roof of a house, the batten system 200 may be oriented such that the TPO membrane 100*a* is on the weather side, facing upward toward the direction of sunlight while the TPO membrane 100*b* is on the deck side, facing downward toward the roof deck. The batten system 200 may be installed on a roof substrate, such as a roof deck (not shown), using a variety of approaches. One approach may employ mechanical fastening with screws and/or nails (not shown) through the batten system 200 and into a roof substrate. Specifically, the batten system 200 may be mechanically fastened to the roof substrate with screws and/or nails received through one or more of the sealed areas 204 of the batten system 200. Another approach is to coat the deck side of the TPO membrane 100*b* with an adhesive, such as pressure sensitive adhesive, and laminate the batten system 200 to the roof substrate.

Figure 3A:
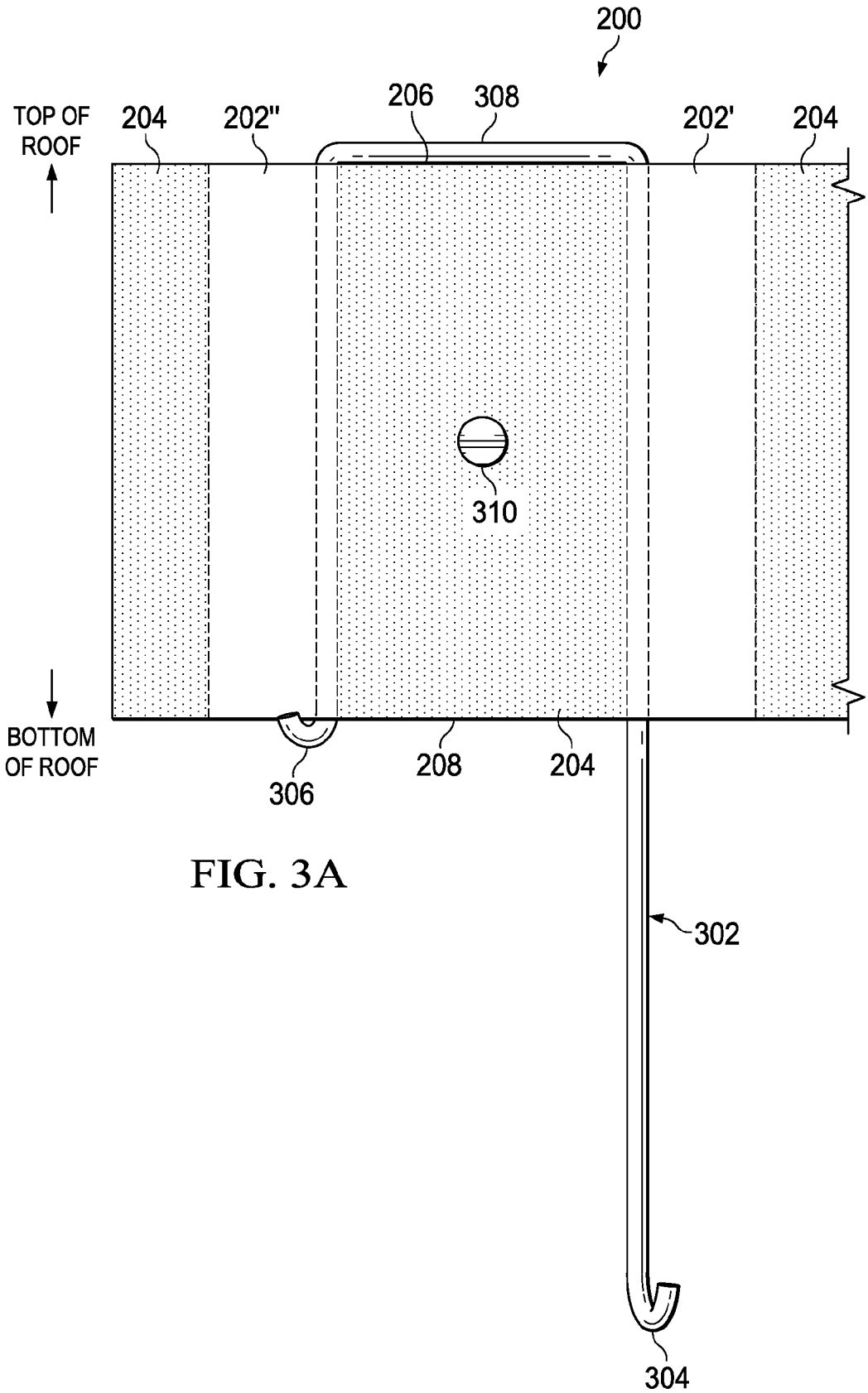
FIG. 3A is a partial, top view of the TPO batten system of FIGS. 2A and 2B with a coupling device received therethrough, in accordance with one embodiment of the present disclosure.
Figure 3B:
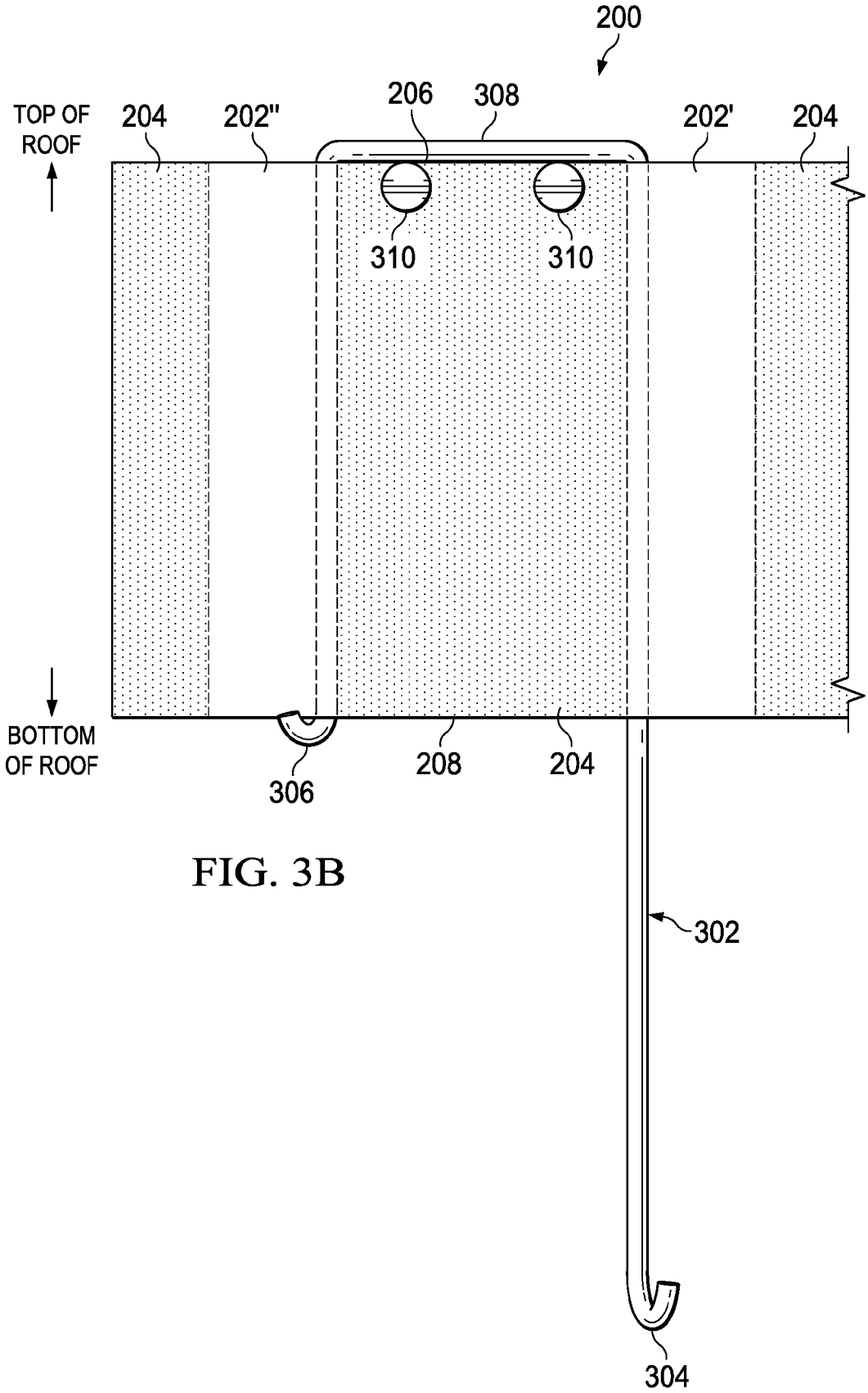
FIG. 3B is a partial, top view of the TPO batten system of FIGS. 2A and 2B with a plurality of coupling devices received therethrough, in accordance with one embodiment of the present disclosure.

FIG. 3A is a partial, top view of the TPO batten system of FIGS. 2A and 2B with a coupling device received therethrough. FIG. 3B is a partial, top view of the TPO batten system of FIGS. 2A and 2B with a plurality of coupling devices received therethrough. In an embodiment, the coupling device 302 may comprise a hanger operable to be received through one of the unsealed areas 202 in the TPO batten system 200. Hangers may be suitable for incorporation into the TPO batten system 200 since they can be easily installed and removed to facilitate proper support for the slate. In an embodiment, the coupling device 302 may be made of spring tempered stainless steel.

The coupling device 302 may comprise a first member 304 and a second member 306. The coupling device 302 may be received into the TPO batten system 200 from the edge 206 of the TPO batten system 200. The first member 304 may be received into and through a first unsealed area 202' while the second member 306 may be received into and through an adjacent second unsealed area 202". When the coupling device 302 is received through the unsealed areas 202', 202", a portion 308 of the coupling device 302 may contact (e.g., rest against) the first edge 206 formed at the sealed area 204. The second member 306 of the coupling device 302 may be configured to prevent the coupling device 302 from backing out of and away from the TPO batten system 200 when the unsealed area 202" substantially closes when the first TPO membrane 100*a* lies substantially against the second TPO membrane 100*b*. The second member 306 may include a tail, a latch, or a shoulder that is operable to engage second edge 208. In an embodiment, and as shown in FIGS. 3A and 3B, the second member 306 may comprise a tail that is operable to be received through unsealed area 202" and then hook around and engage with the second edge 208 of the TPO batten system 200, preventing the coupling device 302 from backing out of and away from the TPO batten system 200.

Figure 6:
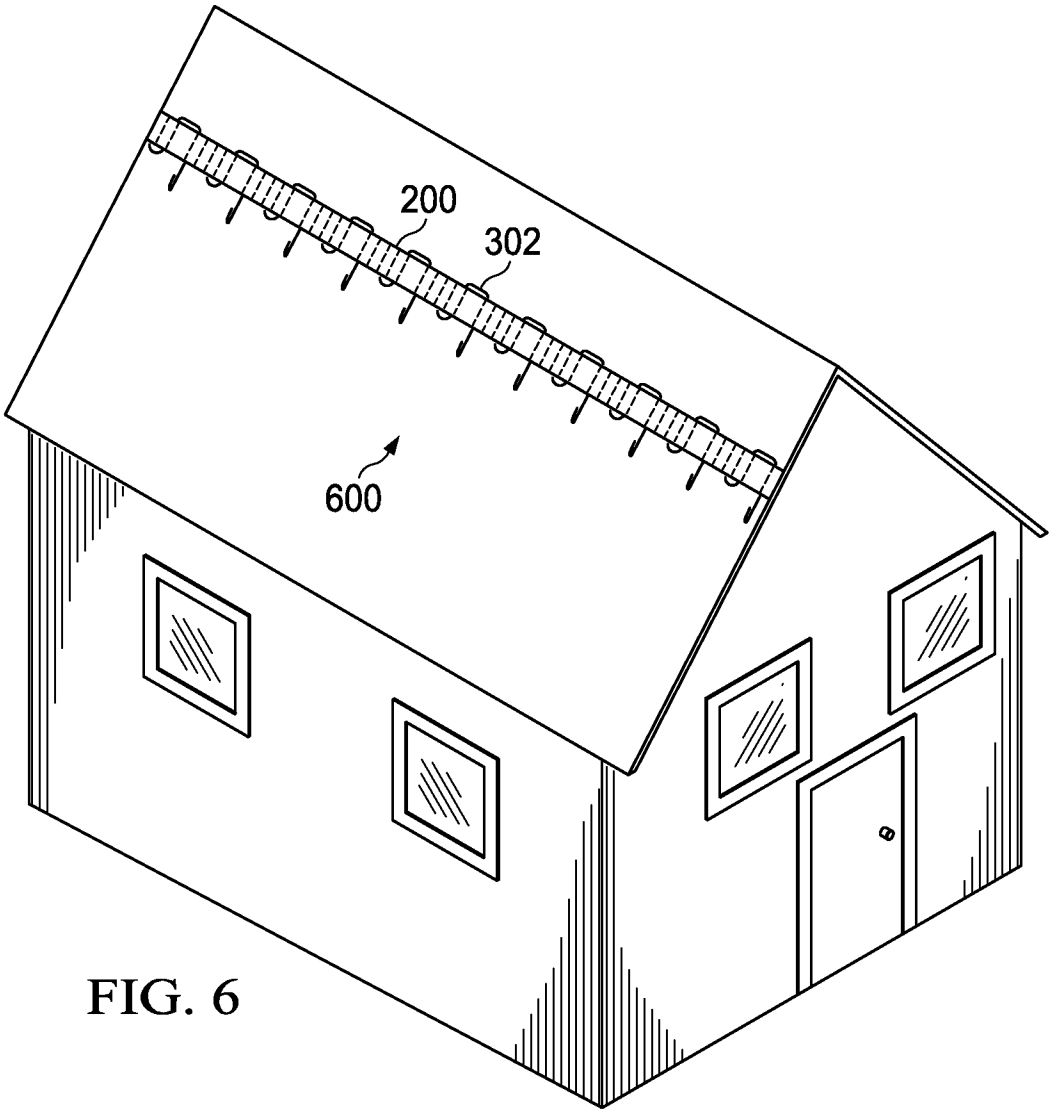
FIG. 6 is perspective view of the TPO batten system installed on a roof, in accordance with the present disclosure.

When a slate shingle (not shown) is attached to the first member 304 of the coupling device 302, gravity may pull the portion 308 of the coupling device 302 against the edge 206 of the TPO batten system 200. When the TPO batten system 200 is installed on a roof deck, as shown in FIG. 6, the first member 304 of the coupling device 302 may be designed to transfer the hanging weight of the slate shingle from the coupling device 302 to the roof deck, thereby reducing the load on the TPO batten system 200 and spreading the weight of one or more slate shingles across the roof deck.

Referring back to FIGS. 3A and 3B, while the TPO material in the TPO batten system 200 may provide sufficient strength to maintain the integrity of the batten system 200, the elasticity of the TPO material may allow the TPO batten system 200 to deform slightly under the weight of the slate shingle. In some embodiments, over time, the weight of the coupling device 302 and slate shingle may cause the heat sealed TPO membranes 100*a*, 100*b* to begin to separate at the sealed areas 204. If the heat sealed TPO membranes 100*a*, 100*b* become separated, the installation of the slate shingles may become unstable. Accordingly, in an embodiment, a fastener 310 may be inserted into the TPO batten system 200 to enhance the mechanical rigidity and reduce the deformation of the TPO batten system 200. The fastener 310 may be inserted through the TPO batten system 200 after the two TPO membranes 100*a*, 100*b* are heat sealed together or the two TPO membranes 100*a*, 100*b* may be heat sealed together around the fastener 310.

One or more fasteners 310 may be inserted into the TPO batten system 200 in one or more sealed areas 204. In FIG. 3A, one fastener 310 is shown located approximately in a middle portion of the sealed area 204 of the batten system 200 from the edge 206 to the edge 208 of the TPO batten system 200. In this configuration, when the coupling device 302 is inserted into the batten system 200, the batten system 200 may give slightly to the point where the portion 308 of the coupling device 302 may rest against the fastener 310. In an embodiment, one fastener 310 may be located in the upper right hand corner of sealed area 204 along the edge 206 of the batten system 200. In FIG. 3B, two fasteners 310 are shown located approximately in the corners of the sealed area 204 along the edge 206 of the batten system 200. In this configuration, the batten system 200 may give very slightly or not at all as the fasteners 310 are positioned at or near the edge 206 of the batten system 200. While top fasteners 310 are illustrated in FIG. 3B, it is to be appreciated that some embodiments may include just one fastener 310 proximate to the edge 206. It is to be further appreciated that other numbers of fasteners may be used, such as 3, 4, 5, 10, etc.

Figure 4A:
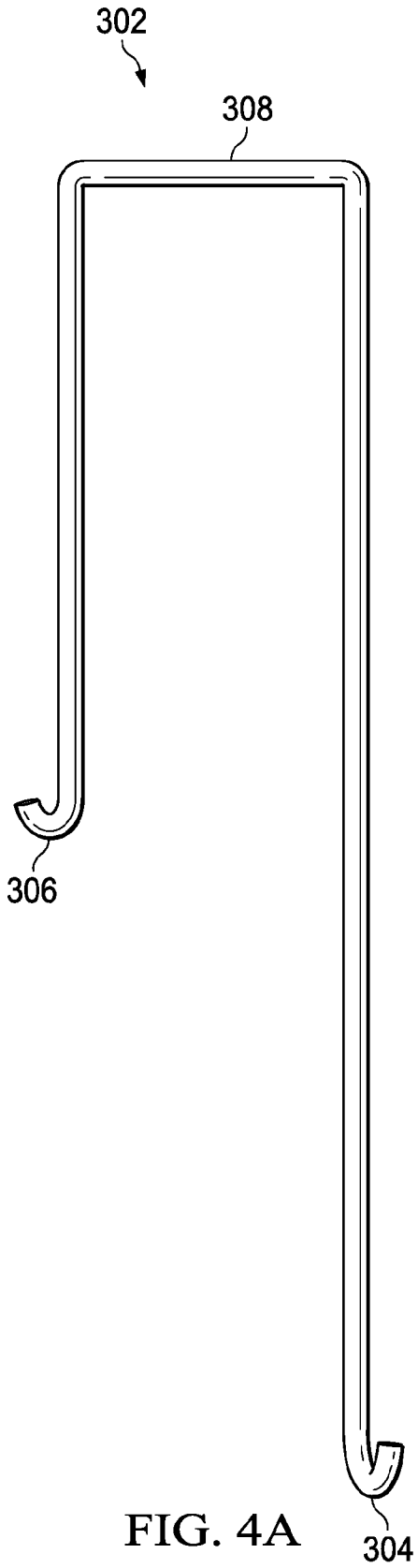
FIG. 4A is a front view of the coupling device of the TPO batten system of FIGS. 3A and 3B, in accordance with one embodiment of the present disclosure.
Figure 4B:
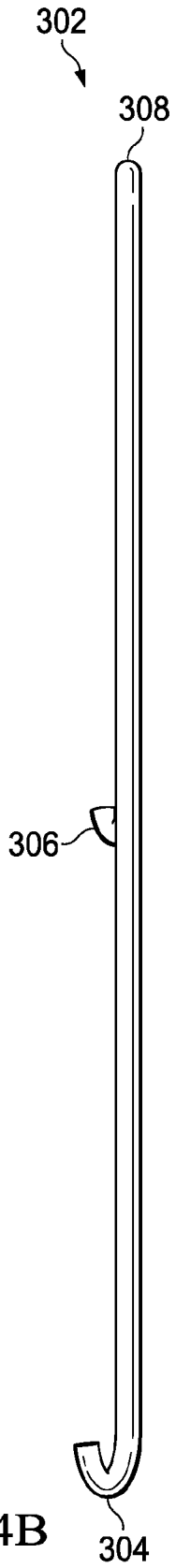
FIG. 4B is a side view of the coupling device of FIG. 4A, in accordance with one embodiment of the present disclosure.

FIG. 4A is a front view of the coupling device of the TPO batten system of FIGS. 3A and 3B. FIG. 4B is a side view of the coupling device of FIG. 4A. As previously discussed, the coupling device 302 may comprise the first member 304, the second member 306, and the portion 308. The first member 304 may comprise a hook that may configured to extend outwardly from a roof when the TPO batten system is installed on the roof deck. The hook of the first member 304 may be configured to receive and mate with a slate shingle (not shown). Accordingly, the first member 304 may extend outwardly at least the thickness of a slate shingle in order to receive a lower edge of the slate shingle in the hook.

The second member 306 may comprise a tail that may also be configured to extend outwardly from a roof when the TPO batten system is installed on the roof deck. The second member 306 may hook around and engage with the second edge (not shown) of the TPO batten system, preventing the coupling device 302 from backing out of and away from the TPO batten system. Compared to the first member 304, the second member 306 may not need extend outwardly as far as the first member 304. It may be desired that the second member 306 extend outwardly just enough to hook around and engage with the second edge of the TPO batten system.

The portion 308 may be configured to mate with the sealed areas (not shown) of the TPO batten system. When a slate shingle (not shown) is received in the first member 304, gravity may pull the coupling device 302 down the fall line of the roof deck until the portion 308 of the coupling device 302 comes until contact with the first, top edge the unsealed area of the TPO batten system.

Figure 5:
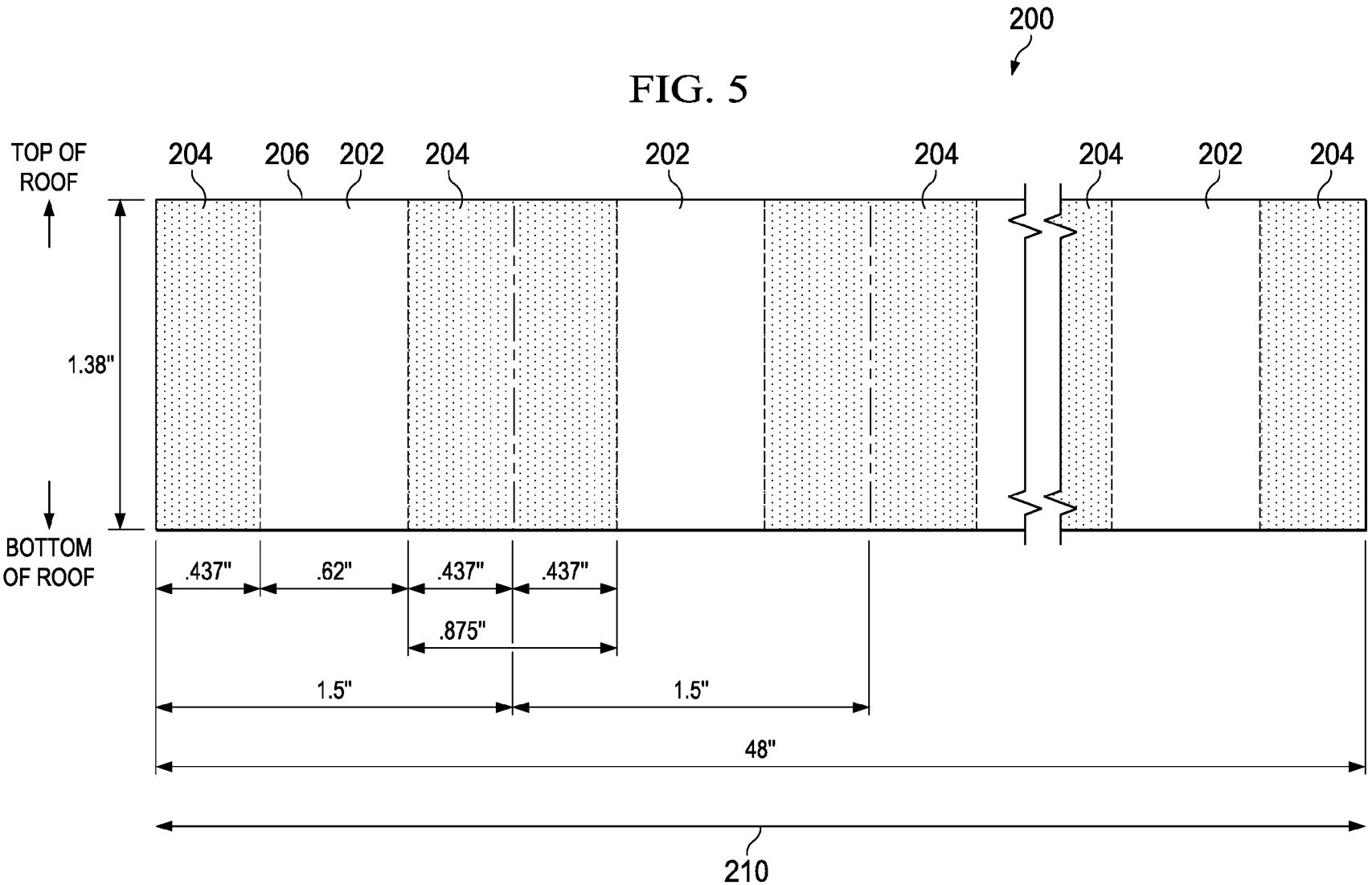
FIG. 5 is a partial, top view of the TPO batten system of FIG. 2B with dimensions shown, in accordance with one embodiment of the present disclosure.

FIG. 5 is a partial, top view of FIG. 2B with dimensions shown, in accordance with one embodiment of the present disclosure. In an embodiment, the TPO batten system 200 may be about 1.25" to 1.5" tall, and more specifically about 1.30" to 1.45" tall, and even more specifically about 1.38" tall, as measured from the edge 206 to the edge 208. In an embodiment, the TPO batten system 200 may be about 36" to 60" long, and more specifically about 42" to 54" long, and even more specifically about 46" to 50" long, as measured along the longitudinal direction 210. Because the length of the roof in FIG. 4 may be longer than 48", a separate TPO batten system 200 may be installed on the roof every four feet.

Referring back to FIG. 5, in an embodiment, each unsealed area 202 may be about 0.40" to 0.85" wide, and more specifically about 0.50" to 0.75" wide, and even more specifically about 0.60" to 0.65" wide, as measured along the longitudinal direction 210. In an embodiment, each sealed area may be about 0.65" to about 1.10" wide, and more specifically about 0.75" to 1.00" wide, and even more specifically about 0.85" to 0.90" wide, as measured along the longitudinal direction 210. The width from the center of each sealed area 204 to the center of the adjacent sealed areas 204, as measured along the longitudinal direction 210 may be about 1.25" to 1.75", and more specifically about 1.35" to 1.65", and even more specifically about 1.45" to 1.55". The dimensions of the batten system 200 may be configured according to the embodiments disclosed herein to minimize cost and to allow for ease of installation In an exemplary embodiment and as shown in FIG. 5, the material cost for two 1.38"×48" TPO membranes 100*a*, 100*b* comprising each batten system 200 may be approximately $0.26 and may allow for optimized cost savings compared to a metallic batten system. Although in the exemplary embodiment the membranes 100*a*, 100*b* are 1.38"×48", the membranes 100*a*, 100*b* of the batten system 200 may be shorter and/or longer in either dimension to minimize cost and to allow for ease of installation.

FIG. 6 is perspective view of the TPO batten system 200 installed on a roof deck 600. As shown, one or more batten systems 200 may be installed to run the length of the roof deck 600 from one end of the structure to the other. A plurality of coupling devices 302 may be spaced at desired intervals along the batten system 200 with a first member of each of the plurality of coupling devices 302 hanging down from the batten system 200. While only one batten system 200 is shown in FIG. 6, a plurality of batten systems 200 may be installed at desired intervals from the top of the roof deck 600 to the bottom of the roof deck 600 so that coupling devices 302 may cover substantially all of the surface of the roof deck 600. One or more slate shingles (not shown) may be attached to each of the coupling devices 302 so that the slate shingles make a continuous roofing surface on the roof deck 600.

While various embodiments in accordance with the disclosed principles have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically, a description of a technology in the "Background" is not to be construed as an admission that technology is prior art to any invention(s) in this disclosure. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings herein.

What is claimed is:

1. A roofing batten system comprising:

a first thermoplastic polyolefin (TPO) membrane comprising a first TPO scrim layer disposed between a first TPO upper layer and a first TPO lower layer; and a second TPO membrane comprising a second TPO scrim layer disposed between a second TPO upper layer and a second TPO lower layer;

wherein the first TPO lower layer is heat sealed with the second TPO upper layer at sealed areas while leaving a plurality of unsealed areas between the first TPO lower layer and the second TPO upper layer at intervals; and wherein one or more coupling devices may be received through adjacent unsealed areas between the first TPO lower layer and the second TPO upper layer such that each coupling device may be fastened to the roofing batten system by mating at a first edge of a sealed area and hooking at a second edge of the sealed area.

2. A roofing batten system comprising:

a first thermoplastic polyolefin (TPO) membrane comprising a first TPO upper layer, a first TPO lower layer, and, optionally, a first TPO scrim layer disposed therebetween; and a second TPO membrane comprising a second TPO upper layer, a second TPO lower layer, and, optionally, a second TPO scrim layer disposed therebetween;

wherein the first TPO lower layer is heat sealed with the second TPO upper layer at sealed areas while leaving a plurality of unsealed areas between the first TPO lower layer and the second TPO upper layer at intervals; and wherein adjacent unsealed areas between the first TPO lower layer and the second TPO upper layer are configured to receive a coupling device such that the coupling device contacts a first edge of an interposing sealed area and secures at a second edge of the interposing sealed area.

3. A roofing batten system according to claim 2, wherein a received coupling tool comprises a first portion receivable in a first unsealed area, a second portion contactable with the first edge, a third portion receivable in a second unsealed area, and a fourth portion securable to the second edge.

4. A roofing batten system according to claim 3, wherein the fourth portion of the coupling tool comprises a hook, a tail, a latch, a shoulder or combinations thereof.

5. A roofing batten system according to claim 2, wherein the coupling tool has a generally rectangular shape with one open side or a generally hexagonal shape with one open side.

6. A roofing batten system according to claim 2, wherein a first unsealed area and a second unsealed area are substantially parallel to each other.

7. A roofing batten system according to claim 2, wherein a first unsealed area, a second unsealed area, or both the first unsealed area and the second unsealed area are substantially parallel to a fall line.

8. A roofing batten system comprising:

a first thermoplastic polyolefin (TPO) membrane comprising a first TPO upper layer, a first TPO lower layer, and, optionally, a first TPO scrim layer disposed therebetween;

a second TPO membrane comprising a second TPO upper layer, a second TPO lower layer, and, optionally, a second TPO scrim layer disposed therebetween;

a first sealed area comprising a heat seal between a first portion of the first TPO lower layer and a first portion of the second TPO upper layer;

a second sealed area comprising a heat seal between a second portion of the first TPO lower layer and a second portion of the second TPO upper layer; and a third sealed area comprising a heat seal between a third portion of the first TPO lower layer and a third portion of the second TPO upper layer, wherein the first sealed area and the second sealed area are separated by a first unsealed area, wherein the second sealed area and the third sealed area are separated by a second unsealed area, and wherein the first unsealed area and the second unsealed area are configured to receive a coupling device between the first TPO lower layer and the second TPO upper layer.

9. A roofing batten system according to claim 8, wherein the first TPO membrane and the second TPO membrane together define an upper edge and a lower edge.

10. A roofing batten system according to claim 9, wherein the first unsealed area is further configured to permit a received coupling tool to contact the upper edge, and the second unsealed area is further configured to permit the received coupling tool to be secured at the lower edge.

11. A roofing batten system according to claim 10, wherein the received coupling tool comprises a first portion receivable in the first unsealed area, a second portion contactable with the upper edge, a third portion receivable in the second unsealed area, and a fourth portion securable to the lower edge.

12. A roofing batten system according to claim 11, wherein the fourth portion of the coupling tool comprises a hook, a tail, a latch, a shoulder or combinations thereof.

13. A roofing batten system according to claim 8, wherein a coupling tool has a generally rectangular shape with one open side or a generally hexagonal shape with one open side.

14. A roofing batten system according to claim 8, wherein the first unsealed area and the second unsealed area are substantially parallel to each other.

15. A roofing batten system according to claim 8, wherein the first unsealed area, the second unsealed area, or both the first unsealed area and the second unsealed area are substantially parallel to a fall line.

16. A roofing batten system according to claim 8, wherein the first TPO membrane comprises the first TPO scrim layer and the second TPO membrane comprises the second TPO scrim layer.

17. A method of securing a shingle to a roof with a roofing batten system comprising:

a first thermoplastic polyolefin (TPO) membrane comprising a first TPO upper layer, a first TPO lower layer, and, optionally, a first TPO scrim layer disposed therebetween;

a second TPO membrane comprising a second TPO upper layer, a second TPO lower layer, and, optionally, a second TPO scrim layer disposed therebetween;

a first sealed area comprising a heat seal between a first portion of the first TPO lower layer and a first portion of the second TPO upper layer;

a second sealed area comprising a heat seal between a second portion of the first TPO lower layer and a second portion of the second TPO upper layer; and a third sealed area comprising a heat seal between a third portion of the first TPO lower layer and a third portion of the second TPO upper layer, wherein the first sealed area and the second sealed area are separated by a first unsealed area, and wherein the second sealed area and the third sealed area are separated by a second unsealed area, wherein the first unsealed area and the second unsealed area are configured to receive a coupling device between the first TPO lower layer and the second TPO upper layer, the method comprising:

fixing the second TPO lower layer to a roof substrate;

inserting a coupling tool comprising a first portion, a second portion, a third portion, and a fourth portion into the first unsealed area and the second unsealed area such that the first portion is received in the first unsealed area, the second portion contacts the upper edge of the second sealed area, the third portion is received in the second unsealed area, and the fourth portion secures the coupling tool; and hanging a shingle from the coupling tool.

18. A method of securing a shingle to a roof with a roofing batten system according claim 17, wherein the shingle comprises slate.

19. A method of securing a shingle to a roof with a roofing batten system according to claim 17, wherein the fixing the second TPO lower layer to the roof substrate further comprises mechanically fastening the second TPO lower layer to the roof substrate.

20. A method of securing a shingle to a roof with a roofing batten system according to claim 17, wherein the fixing the second TPO lower layer to the roof substrate further comprises coating the deck side of the second TPO lower layer with an adhesive and laminating the roofing batten system to the roof.

* * * * *